US007170506B2

(12) United States Patent
Eldon et al.

(10) Patent No.: US 7,170,506 B2
(45) Date of Patent: Jan. 30, 2007

(54) HYBRID ELECTRONIC DISPLAY OF LIGHT EMISSIVE DISPLAY ELEMENTS AND LIGHT REFLECTIVE DISPLAY ELEMENTS

(75) Inventors: James Eldon, Farnborough (GB); Simon Lawton, Scunthorpe (GB)

(73) Assignee: Nokia Corporation, Espoo (FI)

( * ) Notice: Subject to any disclaimer, the term of this patent is extended or adjusted under 35 U.S.C. 154(b) by 267 days.

(21) Appl. No.: 10/442,808

(22) Filed: May 20, 2003

(65) Prior Publication Data

US 2003/0218595 A1 Nov. 27, 2003

(30) Foreign Application Priority Data

May 22, 2002 (GB) ..... 0211793.5

(51) Int. Cl.
*G09G 5/00* (2006.01)

(52) U.S. Cl. ..... 345/207; 345/76; 345/87; 345/107; 315/169.3; 349/61; 349/117

(58) Field of Classification Search ..... 345/87, 345/107, 84, 76, 207; 315/169.3; 349/74, 349/49, 61, 117
See application file for complete search history.

(56) References Cited

U.S. PATENT DOCUMENTS

| | | | | |
|---|---|---|---|---|
| 4,163,332 | A * | 8/1979 | Salam | 40/449 |
| 4,580,877 | A | 4/1986 | Washo | 350/345 |
| 5,808,711 | A * | 9/1998 | Suppelsa et al. | 349/74 |
| 6,091,194 | A | 7/2000 | Swirbel et al. | 313/498 |
| 6,144,359 | A * | 11/2000 | Grave | 345/102 |
| 6,195,140 | B1 * | 2/2001 | Kubo et al. | 349/44 |
| 6,445,489 | B1 * | 9/2002 | Jacobson et al. | 359/296 |
| 6,842,170 | B1 * | 1/2005 | Akins et al. | 345/173 |
| 2001/0035924 | A1 | 11/2001 | Fujieda | 349/65 |
| 2003/0098856 | A1 * | 5/2003 | Li | 345/173 |

* cited by examiner

*Primary Examiner*—Henry N. Tran
(74) *Attorney, Agent, or Firm*—Harrington &Smith, LLP

(57) ABSTRACT

A hybrid electronic display combines one or more light emissive display elements (33) and one or more reflective display elements (34). The respective display element types (33, 34) are configured to display a representation of the same information to a viewer of the display and are activatable to compensate for variations in ambient lighting conditions.

29 Claims, 5 Drawing Sheets

HYBRID ELECTRONIC DISPLAY OF LIGHT EMISSIVE DISPLAY ELEMENTS AND LIGHT REFLECTIVE DISPLAY ELEMENTS

INTRODUCTION

The present invention relates to an electronic display. The invention also relates to an electronic device incorporating the display such as a mobile telecommunications device or personal data assistant (PDA). For ease of understanding, the invention will be described in its application to an electronic display of a mobile telecommunications device such as a mobile telephone.

BACKGROUND OF THE INVENTION

Electronic displays of the type used in small handheld electronic devices such as mobile telephones and PDA's are well known. It is known to provide a mobile telephone with a conventional liquid crystal display (LCD) to provide the user with information concerning the status of the telephone and to enable a large number of different functions to be accessed and selected easily.

An LCD is a reflective display which means that there must be at least some ambient light for it to be seen. In situations where the ambient light is too low or in darkness, an LCD cannot be seen at all. For this reason an LCD is often provided with a backlight, such as an array of light emitting diodes (LED's) positioned around the periphery of the display, to illuminate it. An alternative to an array of LED's is an electroluminescent film beneath the display that glows when current is passed through it, thereby illuminating the LCD display from below.

A problem with a conventional display such as an LCD described above is that they suffer from poor contrast and so are difficult or impossible to see easily in well lit environments or in bright sunlight. Even in low light or dark environments, when the display is illuminated using an array of LED's or an electroluminescent film, the contrast of the display is low and readability is poor.

It is an object of the present invention to overcome or substantially alleviate the disadvantages with the conventional displays such as those discussed above and to provide a display that provides a high degree of display legibility in dynamic lighting environments.

SUMMARY OF THE INVENTION

According to the present invention, there is provided a hybrid electronic display comprising a combination of one or more light emissive display elements and one or more light reflective display elements, the respective display element types being configured to display a representation of the same information to a viewer of the display and wherein the respective display element types are activatable to compensate for variations in ambient lighting conditions.

Display element is used in the sense that it is a graphic icon which is fixed or can change over time, and which singularly and/or in combination with other display elements can be used to represent figure and/or text information.

In contrast to a reflective display element, emissive display elements do not require significant ambient lighting to be seen by a viewer and thus the present invention allows the displayed information to be seen in varying lighting conditions.

Preferably, the respective display element types are arranged to display complementary images of one another.

One or both types of the display elements may be opaque or translucent. However, the reflective display element is preferably opaque.

In a preferred embodiment, one display element type is configured to be actuable separately from the other display element type depending on ambient lighting conditions.

The hybrid electronic display may comprise a light sensor operable to activate one of the display element types in dependence on the ambient lighting conditions.

The light sensor is preferably operable to activate the light emissive display element in comparatively dark ambient lighting conditions.

Preferably, each display element type is operable to display information visible over different regions of the display.

In a preferred embodiment, the display element types are configured so that information displayed on one display element type is visible through one or more gaps in the other display element type.

The reflective display element advantageously comprises an electrophoretic display element.

The electrophoretic display element is preferably formed from a plurality of electrophoretic microcapsules disposed on an electrode substrate layer.

Conveniently, the electrophoretic microcapsules are arranged in groups, the light emissive display element being visible to a viewer of the display between the groups of electrophoretic microcapsules.

The electrophoretic display element is preferably opaque in the region of the display occupied by groups of electrophoretic microcapsules.

In one embodiment, a transparent insulating layer is disposed between the light emissive and reflective display elements.

The hybrid electronic display of the present invention preferably comprises a plurality of display segments, each segment comprising a light emissive display element and a reflective display element.

The light emissive and light reflective display elements are preferably configured such that a region corresponding to a central section of each display segment is formed from the reflective display element and a region corresponding to a peripheral rim of each display segment is formed from the light emissive display element.

The respective display element types are conveniently arranged in layers that are preferably flexible and/or shapable. For example, one or more of the layers may be formed from a film which is shapable in 2D/3D, e.g. into a concave/convex arc (3D shaping) or a circular/triangular outline perimeter when viewed from above (2D shaping).

In a preferred embodiment, the respective display element types are arranged to fall within the line of sight of a viewer of the display.

Advantageously, the respective display element types are adjacent to each other in a direction along the line of sight of a viewer of the display.

According to the present invention, there is also provided a mobile telecommunications device incorporating the hybrid electronic display comprising a combination of one or more light emissive display elements and one or more light reflective display elements, the respective display element types being configured to display a representation of the same information to a viewer of the display and wherein the respective display element types are activatable to compensate for variations in ambient lighting conditions. Because the display according to the invention includes both reflective and light emissive components, the lack of illumination of the reflective display element in low or zero ambient lighting conditions is compensated by the light emissive display element and, in bright light conditions, the reflective display element compensates for the poor visibility of the light emissive display element. Therefore, the same information is visible to the user of the display but in a different format depending on whether the information is being presented to the viewer by the reflective or light emissive display element and on the ambient lighting conditions. The combination of both types of display therefore forms a partnership that overcomes the problems of known displays.

BRIEF DESCRIPTION OF THE DRAWINGS

An embodiment of the invention will now be described, by way of example only, with reference to the accompanying drawings, in which.

DETAILED DESCRIPTION OF THE INVENTION

Figure 1:
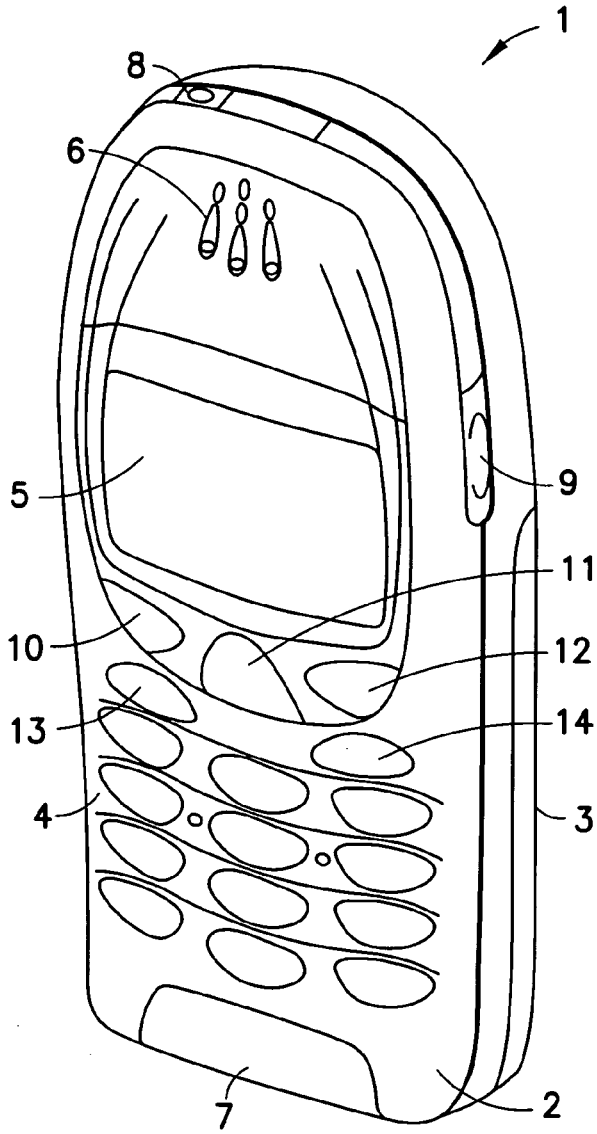
FIG. 1 shows a mobile telephone according to a preferred embodiment of the present invention.

The preferred electronic device to which this invention is applicable is a mobile telephone such as that illustrated in FIG. 1. The telephone 1 has a front casing portion 2, and a rear casing portion 3. A user interface is provided in the front casing portion 2 and comprises a keypad 4, an electronic display 5, an ear-piece 6, a microphone 7 and an on/off key 9. The telephone 1 is adapted to enable communication via a wireless telecommunications network, e.g. a cellular network. However, the telephone 1 could also be designed for a cordless network.

The keypad 4 has a first group of keys that are alphanumeric to enable a user to enter a telephone number, write a text message (SMS) or enter a name associated with a particular number, etc. The keypad 4 additionally includes five soft keys 10,11,12,13,14. The first soft key 10 is used to access the menu structure and to select a function in the menu. Its function changes depending on the status of the telephone 1. The second soft key 11 is used to scroll up and down in the display 5 whilst a menu is displayed. The third soft key 12 is used to enter the phonebook options when the telephone 1 is in a standby position. However, when in the menu structure, the third soft key 12 is used to close the menu structure or erase entered characters. The fourth and fifth soft keys 13,14 are call handling keys. The first call handling key 13 is used to start a call or establish a conference call and the second call handling key 14 is used to end a conference call or reject an incoming call.

Figure 2:
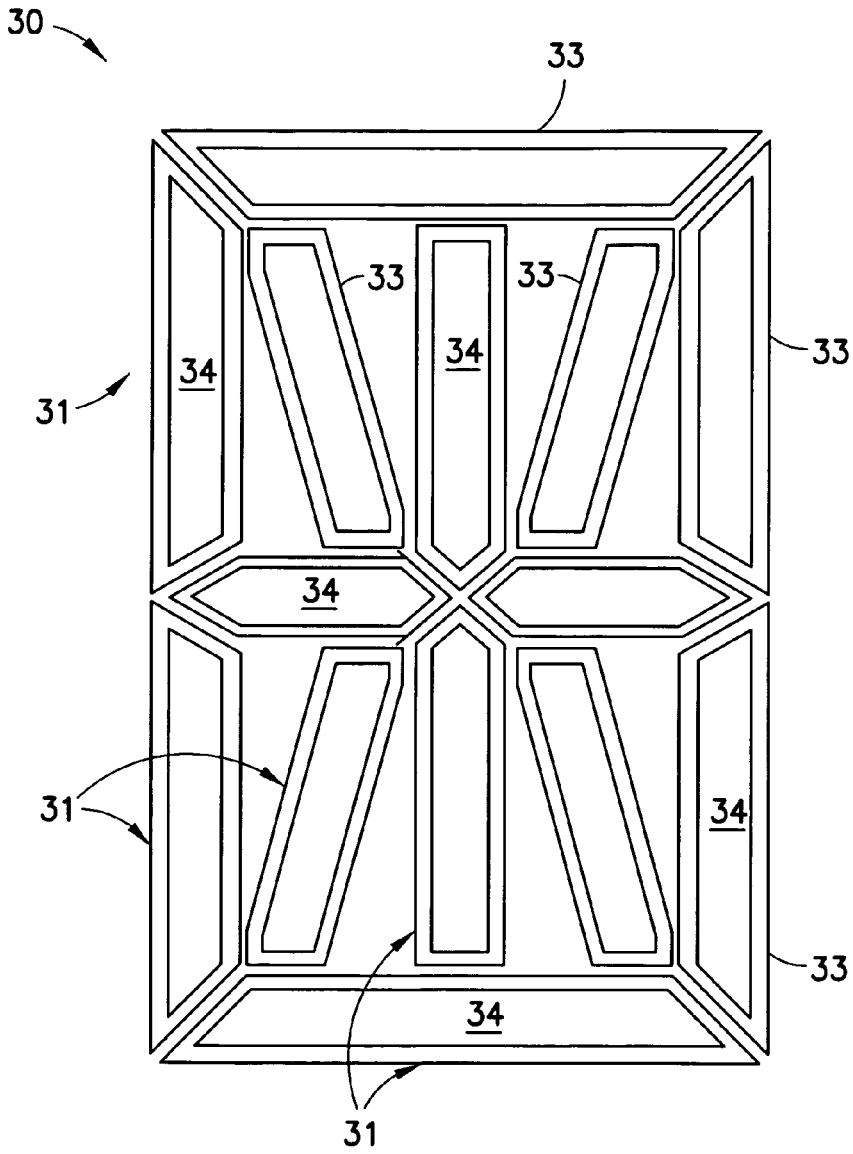
FIG. 2 shows a plan view of a fourteen-segment display according to the present invention.

Referring now to FIG. 2, there is shown a 14-segment display 30 according to an embodiment of the invention. Segment displays are commonly found on products requiring a simple display for numbers and text. Each segment 31 of the display is made up of a light emissive display element 33 and a reflective display element 34 to enable the display to be seen irrespective of the ambient lighting conditions. In a preferred embodiment the light emissive display element 33 of each segment 31 incorporates electroluminescent material whereas the reflective display element 34 of each segment 31 incorporates electrophoretic pigments. One type of electrophoretic display formed from electrophoretic pigments is commonly made by, and known by the trade name, "Electronic Ink"™. Electrophoretic displays have higher reflectance and contrast than LCDs and provide paper-like readability with ultra-low power consumption and so offer many advantages over an LCD display especially when used in a mobile telephone where power consumption and readability due to the small size of the display is paramount. However, although an electrophoretic display offers a significant improvement over an LCD display, because it is reflective display like an LCD, a backlight is still required in conditions of low or zero illumination. Therefore, the electrophoretic display element is complemented with a second display element of the light emissive type formed integrally with the first display element to form a unitary electronic display.

It must be noted that the invention is not limited to displays incorporating electrophoretic pigments and electroluminescent materials and other combinations of reflective and light emissive display types may also be employed. For example, other light emissive technologies include light emitting polymer (LEP) and organic light emitting diodes (OLED) and another type of known reflective display employs electro-chromic technology.

It will be noted that each segment 31 is configured with the central or inner region formed from the reflective display element 34 and an outer peripheral region or rim formed from the light emissive display element 33. This arrangement is preferred because the central or inner region of each segment 31 can be seen in good ambient light conditions and, in comparatively low ambient lighting conditions, when the reflective display element 34 cannot be seen, the light emissive display element 33 forming the peripheral outer rim of each segment 31 is visible instead. It will be appreciated that the segments 31 may also be formed with their inner or central regions formed from light emissive display elements 33 and their peripheral regions formed from the reflective display elements 34. Therefore either the general outline or the main bodily part of each segment 31 can clearly be seen in any lighting condition displaying the same information, albeit in a slightly different format, rendering the display highly effective and adaptable to contrasting light environments.

Figure 3:
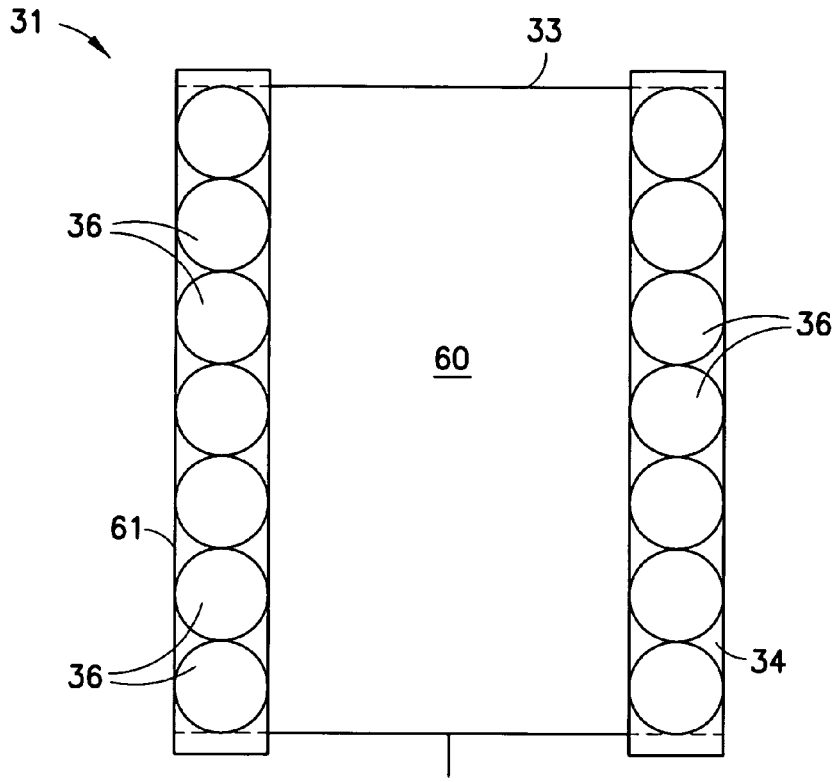
FIG. 3 shows an enlarged view of another display according to the invention.

An enlarged plan view of a portion of an electronic display according to the invention is illustrated in FIG. 3. In this portion, the inner region 60 is formed from an electroluminescent display element 33 and the outer peripheral rim 61 is formed from an electrophoretic display element 34. The construction of the whole hybrid display and the electroluminescent display element 33 will be described in more detail with reference to FIG. 5. However, it can be seen that the electrophoretic display element 34 comprises millions of tiny microcapsules 36 (only seven microcapsules being shown in the greatly enlarged view of FIG. 3). As can be seen from FIG. 4*a*, each microcapsule 36 contains positively charged white particles 37 and negatively charged black particles 38 suspended in a clear fluid 39 and sandwiched between thin electrode sheets 40, 41 above and below the microcapsules 36. When a positive electric field is applied via the lower electrode sheet 40 on which the microcapsules 36 are coated, the white particles 37 move away from the positive electrode field to the top of the microcapsule 36 where they become visible to a user looking at the display in the direction of arrow X in FIG. 4*b*. This makes the surface appear white in that region of the display.

Figure 4A:
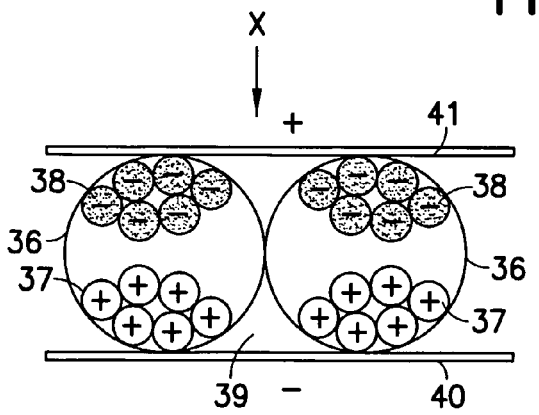
FIG. 4*a* shows an enlarged cross section view through the electrophoretic pigments shown in FIG. 3 when the display appears dark to a user.
Figure 4B:
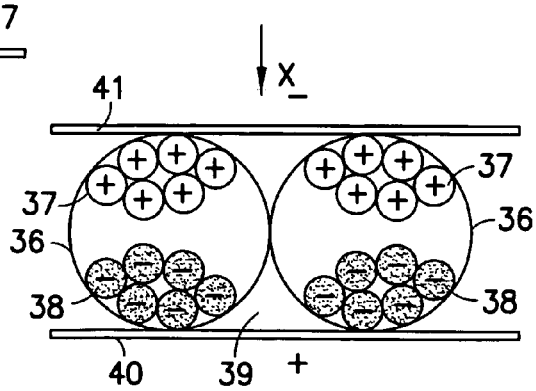
FIG. 4*b* shows an enlarged cross section view through the electrophoretic pigments shown in FIG. 3 when the display appears white to a user.

At the same time, a negative electric field applied to the other electrode sheet 41 pulls the black particles 38 to the bottom of the microcapsules 36 so that they are hidden. If the electric field in each electrode sheet 40,41 is reversed, the opposite occurs so that the black particles 38 appear at the top of the capsule 36 and that region of the display appears dark, as illustrated in FIG. 4*a*.

Figure 5:
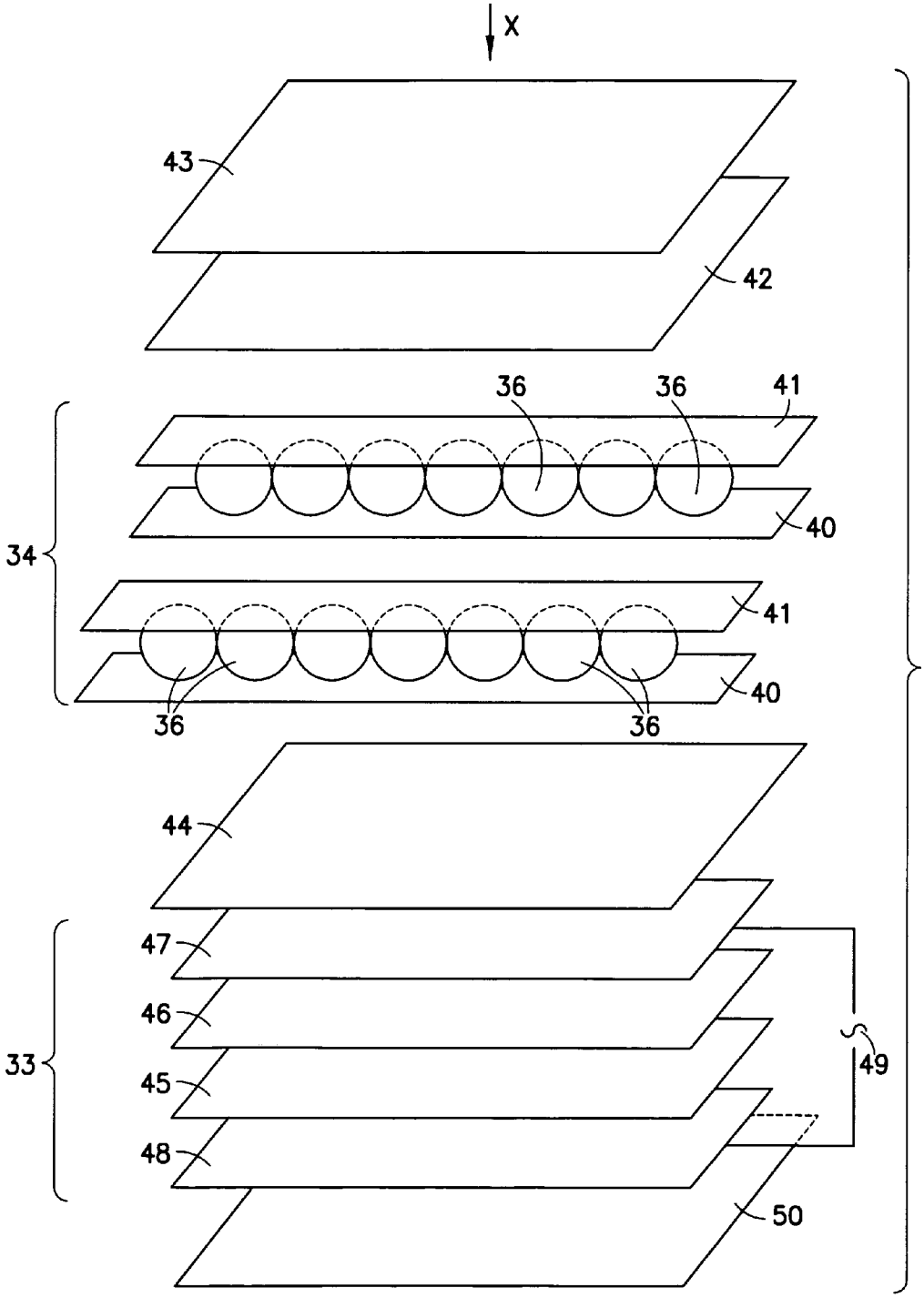
FIG. 5 shows an exploded perspective view of the electronic display according to the present invention.

An exploded perspective view of the hybrid display is shown in FIG. 5. It can be seen that the reflective or electrophoretic display element 34 is disposed on top of the light emissive or electroluminescent display element 33. The electrophoretic display element 34 is arranged so that the electroluminescent display element 33 can be seen beneath the electrophoretic display element 34 by a user viewing the display in the direction indicated by arrow X. More specifically, in the illustrated embodiment, groups of the electrophoretic microcapsules 36 are spaced apart with the electroluminescent display element 33 located beneath them leaving the defined space or central region therebetween free to enable information displayed by the electroluminescent display element 33 to be seen between the groups of electrophoretic display elements 34.

It will be appreciated that it is possible, in an alternative embodiment, for the electoluminescent display element 33 to be positioned above the electrophoretic display element 34. However, the illustrated arrangement is a preferable embodiment.

It should be noted that the electrophoretic display element 33 is opaque in the regions occupied by the electrophoretic microcapsules 36. The light from the electroluminescent display element 33 is therefore visible in those regions not occupied by the groups of electrophoretic microcapsules 36 and it is not possible to see light emitted from a region of the electroluminescent display element 33 positioned directly beneath the groups of microcapsules 36.

When the display is used, an electric potential is applied to each of the electrode layers 40,41 of the electrophoretic display element 34 to cause the particles within each microcapsule 36 to move so that the region of the display formed by the electrophoretic display element 34 is either dark or light.

The hybrid display includes a clear layer 42 located above the electrode sheet 41 to which a UV barrier film or coating 43 is applied. A clear or tinted insulating layer 44 is disposed beneath the lower electrode sheet 40 and separates the electrophoretic display element 34 from the electroluminescent display element 33.

The electroluminescent display element 33 comprises a dielectric 45 coated in phosphor 46 and disposed between a pair of electrodes 47,48 to which an AC voltage may be applied to cause luminescence of the phosphor coating 46 which will be visible beneath the electrophoretic display element 34 as explained above. A polyester backing sheet 50 is disposed beneath the rear electrode 48.

It will be appreciated that when a current is applied to the electrodes of both the electrophoretic display element 34 and the electroluminescent display element 33, information visible to the user is created by both types of display element rendering the information visible in any ambient lighting conditions, the central region of each segment 31 formed by the electrophoretic display element 34 being visible in high ambient light conditions and the peripheral rim of each segment 31 formed by the electroluminescent display element 33 being visible in comparatively dark conditions. It will be appreciated that one display element may be activated independently from the other display element. This may be achieved by providing a switch operable by the user to change the currently operative display. Alternatively, a light sensor may automatically select the best display element to display information to the viewer in dependence on the ambient lighting conditions.

An example of how the display would appear to a user is demonstrated by the sequential animated views of a pair of apples shown in FIG. 6, which illustrates how the display would be seen in low light or dark conditions when only the light emissive display elements 33 are visible, and FIG. 7, which illustrates how the display would be seem in lighted environments when only the reflective display elements 34 are visible. It should be noted that, in this example, the light emissive display elements 33 are located so as to define the outline of the apples to be animated and the reflective display elements 34 form the main body of the apples within the outline (the respective display elements can said to display complimentary images of one another. However, it will be appreciated that the positioning of the light emissive and reflective display elements 33,34 can be reversed.

Figure 6A:
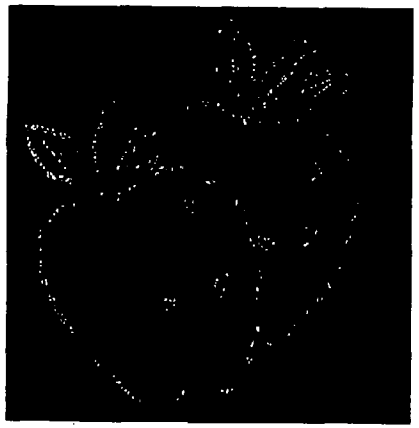
FIGS. 6*a* to 6*c* show example views of a display according to the invention on which is illustrated an animated sequence when in dark or low light conditions and the light emissive display elements are visible.
Figure 6B:
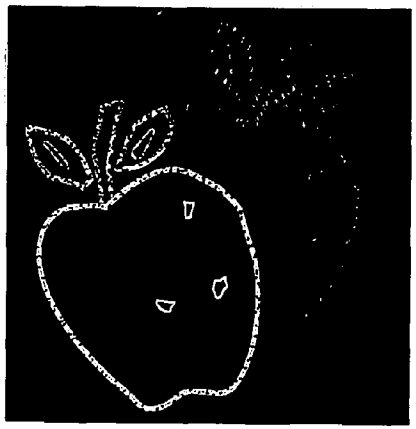
Figure 6C:
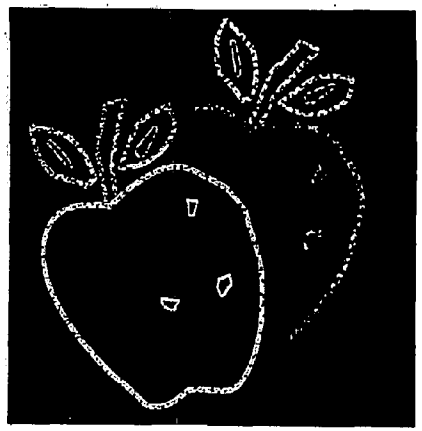

Referring now in more detail to FIG. 6, FIG. 6*a* shows how the display appears when no animation is activated i.e. neither the light emissive or reflective display elements 33,34 are operative. In this situation, the display appears completely blank or only a faint outline of the apples that may be animated are visible. In FIG. 6*b*, the outline of the front apple is illuminated. As indicated above, the outline of the apple is formed by the light emissive elements 33 and so is visible in the low light or dark conditions. The body of the apple within the outline appears black because that part is formed by the reflective display elements 34 that are only visible when there is a sufficient level of ambient light. FIG. 6*c* shows the same view as FIG. 6*b*, but with the outline of the second apple also now made visible by the light emissive display elements 33.

Figure 7A:
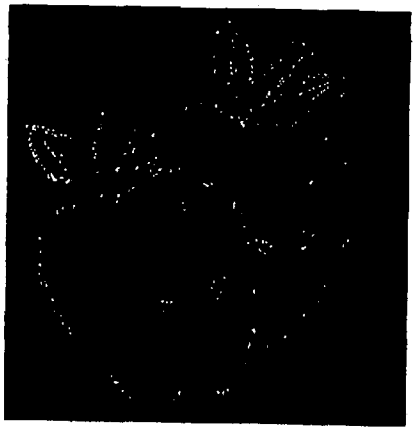
FIGS. 7*a* to 7*c* show example views of a display according to the invention, on which is illustrated the same animated sequence as shown in the views of FIG. 6, when in high ambient light conditions the reflective display elements are visible.
Figure 7B:
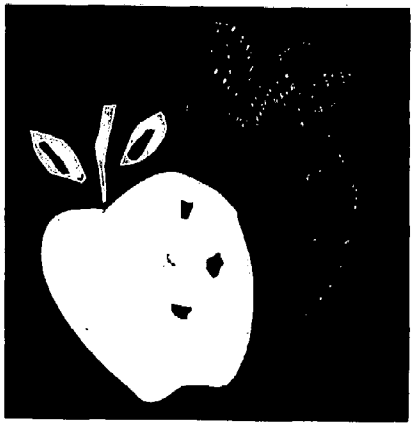
Figure 7C:
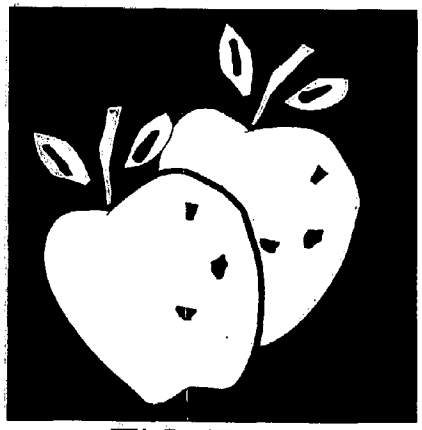

Referring now in more detail to FIG. 7, FIG. 7*a* corresponds to the view of FIG. 6*a* and shows how the display appears when no animation is activated i.e. neither the light emissive or reflective display elements 33,34 are operative. In FIG. 7*b*, the main body of the apple is visible and appears white. As indicated above, the body of the apple is formed from reflective display elements 34 and so this part of the display becomes visible in lighted environments. However, the outline of the apple now appears comparatively black or very faint because the light emissive display elements 33 are not seen easily in well-lighted conditions. FIG. 7*c* shows the same view as FIG. 7*b*, but with the body of the second apple also now made visible by the reflective display elements 34.

It will be appreciated from the foregoing that the electronic display of the present invention is clearly visible in both light and dark environments due to the use of two different display types, one of which relies on reflection and the other which relies on illumination.

Many modifications and variations of the invention falling within the terms of the following claims will be apparent to those skilled in the art and the foregoing description should be regarded as a description of the preferred embodiments only. It will also be appreciated that the electronic display of the present invention is not restricted to applications requiring only small displays such as those used in, for example, mobile telephones. On the contrary, it is also applicable to other types of electronic display such as, for example, electronic sign boards.

The invention claimed is:

1. A hybrid electronic display comprising a combination of one or more light emissive display elements and one or more light reflective display elements, the respective display element types being configured to display a representation of the same information to a viewer of the display and wherein the respective display element types are selectively activatable to compensate for variations in ambient lighting conditions.

2. A hybrid electronic display according to claim 1, wherein one display element type is configured to be actuatable separately from the other display element type depending on ambient lighting conditions.

3. A hybrid electronic display according to claim 2, wherein the respective display element types are arranged to display complementary images of one another.

4. A hybrid electronic display according to claim 1, comprising a light sensor operable to activate one of the display element types in dependence on the ambient lighting conditions.

5. A hybrid electronic display according to claim 4, wherein the light sensor is operable to activate the light emissive display element in comparatively dark ambient lighting conditions.

6. A hybrid electronic display according to claim 1, wherein each display element type is operable to display information visible over different regions of the display.

7. A hybrid electronic display according to claim 1, wherein the display element types are configured so that information displayed on one display element type is visible through one or more gaps in the other display element type.

8. A hybrid electronic display according to claim 1, wherein the reflective display element comprises an electrophoretic display element.

9. A hybrid electronic display according to claim 8, wherein the electrophoretic display element is formed from a plurality of electrophoretic microcapsules disposed on an electrode substrate layer.

10. A hybrid electronic display according to claim 9, wherein the electrophoretic microcapsules are arranged in groups, the light emissive display element being visible to a viewer of the display between the groups of electrophoretic microcapsules.

11. A hybrid electronic display according to claim 10, wherein the electrophoretic display element is opaque in the region of the display occupied by groups of electrophoretic microcapsules.

12. A hybrid electronic display according to claim 1, wherein the light emissive display element comprises an electroluminescent material layer.

13. A hybrid electronic display according to claim 1, wherein a transparent insulating layer is disposed between the light emissive and reflective display elements.

14. A hybrid electronic display according to claim 1 comprising a plurality of display segments, each segment comprising a light emissive display element and a reflective display element.

15. A hybrid electronic display according to claim 14, wherein the light emissive and reflective display elements are configured such that a region corresponding to a central section of each display segment is formed from the reflective display element and a region corresponding to a peripheral rim of each display segment is formed from the light emissive display element.

16. A hybrid electronic display according to claim 1, wherein one or both types of display element are opaque.

17. A hybrid electronic display according to claim 1, wherein one or both types of display element are translucent.

18. A hybrid electronic display according to claim 1, wherein the respective display element types are arranged in layers.

19. A hybrid electronic display according to claim 18, wherein the layers are flexible.

20. A hybrid electronic display according to claim 18, wherein the layers are shapable.

21. A hybrid electronic display according to claim 18, wherein one or more of the layers are formed from a film.

22. A hybrid electronic display according to claim 18, wherein the respective display element types are arranged to fall within the line of sight of a viewer of the display.

23. A hybrid electronic display according to claim 22, wherein the respective display element types are adjacent to each other in a direction along the line of sight of a viewer of the display.

24. A hybrid electronic display according to claim 1, wherein the display elements are arranged to display a graphic icon.

25. A hybrid electronic display according to claim 24, wherein the graphic icon is fixed.

26. A hybrid electronic display according to claim 24, wherein the display elements are arranged to display graphic icons which change over time.

27. A mobile telecommunications device incorporating the hybrid electronic display comprising a combination of one or more light emissive display elements and one or more light reflective display elements, the respective display element types being configured to display a representation of the same information to a viewer of the display and wherein the respective display element types are selectively activatable to compensate for variations in ambient lighting conditions.

28. A hybrid electronic means for displaying comprising a combination of one or more means for light emitting and one or more means for light reflecting wherein the respective means for light emitting and reflecting are themselves configured to display a representation of the same information to a viewer of the means for displaying, and wherein the respective means for light emitting and reflecting are selectively activatable to compensate for variations in ambient light conditions.

29. A mobile telecommunications device incorporating a hybrid electronic means for displaying comprising a combination of one or more means for light emitting and one or more means for light reflecting wherein the respective means for light emitting and reflecting are themselves configured to display a representation of the same information to a viewer of the means for displaying, and wherein the respective means for light emitting and reflecting are selectively activatable to compensate for variations in ambient light conditions.

* * * * *